US008783276B2

(12) United States Patent
Skrzynski et al.

(10) Patent No.: US 8,783,276 B2
(45) Date of Patent: Jul. 22, 2014

(54) COVERING SYSTEM

(75) Inventors: Edward J. Skrzynski, Marco Island, FL (US); Rodney R. Bonard, Naples, FL (US)

(73) Assignee: Marco Canvas and Upholstery LLC, Marco Island, FL (US)

( * ) Notice: Subject to any disclaimer, the term of this patent is extended or adjusted under 35 U.S.C. 154(b) by 593 days.

(21) Appl. No.: 12/954,559

(22) Filed: Nov. 24, 2010

(65) Prior Publication Data

US 2011/0120514 A1 May 26, 2011

Related U.S. Application Data

(60) Provisional application No. 61/264,118, filed on Nov. 24, 2009.

(51) Int. Cl.
*E04H 15/04* (2006.01)
*E04H 15/48* (2006.01)

(52) U.S. Cl.
USPC ..... 135/90; 135/96; 135/152; 135/153

(58) Field of Classification Search
USPC ..... 135/90, 96, 156, 152, 153; 114/361, 114/230.11, 230.1, 231; 248/341, 323, 324, 248/276.1, 282.1, 284.1; 160/333, 335
See application file for complete search history.

(56) References Cited

U.S. PATENT DOCUMENTS 558,401 A * 4/1896 Lobee ..... 114/361
772,175 A 10/1904 Palmer (Continued)

FOREIGN PATENT DOCUMENTS

CA 2088948 A1 8/1994
CA 2266802 A1 2/2000

(Continued)

OTHER PUBLICATIONS

Davit Master Corporation, Pile Mounted Boat Davits, webpage accessed on Jan. 29, 2011, 1 page, http://www.davitmaster.com/4_davits/boatDavits.asp.

(Continued)

*Primary Examiner* — David R Dunn
*Assistant Examiner* — Danielle Jackson
(74) *Attorney, Agent, or Firm* — Hahn Loeser & Parks LLP; Bret A Hrivnak, Esq.

(57) ABSTRACT

The present invention concerns apparatus and methods for covering and uncovering a desired object. Particular embodiments include a covering system comprising: a cover operably connected to a plurality of translational members translationally positioned along a track; two or more hangers having a vertically extending portion and an outwardly extending portion, the track being operably attached to the outwardly extending portion; means for mounting hangers in a rotatable arrangement to a structure about a vertical axis. A further embodiment of the present invention includes a method for covering and uncovering a desired object, the steps including: mounting each of two or more hangers to a structure in a rotatable arrangement, the two or more hangers having a vertically extending portion and an outwardly extending portion; suspending a track from the outwardly extending portion of the two or more hangers; suspending a cover from the track, the cover being translatable along the track; rotating the two or more hangers between a covering position and a stored position, the covering position being arranged to position the track above an object to be covered, and the stored position being arranged to position the track to a side of the object to be covered.

20 Claims, 8 Drawing Sheets

(56) References Cited

U.S. PATENT DOCUMENTS

| | | | | | |
|---|---|---|---|---|---|
| 1,134,630 | A | * | 4/1915 | McGoldrick, J. | 114/361 |
| 2,688,973 | A | | 9/1954 | Reiman | |
| 2,757,678 | A | | 8/1956 | Stahl | |
| 2,965,064 | A | | 12/1960 | Wallace | |
| 3,481,073 | A | | 12/1969 | Yoshida et al. | |
| 3,836,024 | A | | 9/1974 | Mantino | |
| 3,919,963 | A | * | 11/1975 | Cox, III | 114/253 |
| 4,084,599 | A | | 4/1978 | Matthews | |
| 4,284,095 | A | | 8/1981 | Norton | |
| 4,363,284 | A | * | 12/1982 | Monroe | 114/361 |
| 4,448,224 | A | | 5/1984 | Crain | |
| 4,802,314 | A | | 2/1989 | Schildge, Jr. | |
| 4,830,427 | A | | 5/1989 | Fiocchi | |
| 4,991,612 | A | | 2/1991 | Kiss et al. | |
| 5,086,799 | A | * | 2/1992 | Lumbleau | 135/90 |
| 5,269,332 | A | | 12/1993 | Osborne | |
| 5,701,834 | A | * | 12/1997 | Lyons | 114/48 |
| 5,709,501 | A | | 1/1998 | Elbers | |
| 5,769,105 | A | * | 6/1998 | Margol et al. | 135/90 |
| 5,775,353 | A | | 7/1998 | Johnson | |
| 6,062,243 | A | | 5/2000 | Tuch et al. | |
| 6,397,774 | B1 | | 6/2002 | Pranger | |
| 6,786,171 | B1 | | 9/2004 | Elbers | |
| 7,194,976 | B1 | | 3/2007 | Kramer | |
| 7,536,965 | B2 | * | 5/2009 | Johnson | 114/44 |
| 2002/0083969 | A1 | | 7/2002 | Tung | |
| 2003/0000154 | A1 | | 1/2003 | Ignazio | |
| 2005/0089375 | A1 | | 4/2005 | Fox | |
| 2005/0252542 | A1 | | 11/2005 | Basta | |
| 2007/0068634 | A1 | | 3/2007 | Unrast et al. | |
| 2008/0041431 | A1 | | 2/2008 | Tung | |
| 2008/0042027 | A1 | | 2/2008 | LaScala | |
| 2009/0178605 | A1 | | 7/2009 | Tufte | |
| 2009/0293797 | A1 | * | 12/2009 | Kent | 114/361 |
| 2012/0180714 | A1 | | 7/2012 | Bir, Jr. | |

FOREIGN PATENT DOCUMENTS

| | | | |
|---|---|---|---|
| CA | 2452636 | A1 | 6/2004 |
| GB | 997211 | A | 7/1965 |
| JP | H01165842 | A | 6/1989 |
| JP | H10292657 | A | 11/1998 |
| SE | 514452 | C2 | 2/2001 |
| WO | 9921753 | A1 | 5/1999 |
| WO | 2007082403 | A1 | 7/2007 |
| WO | 2008014264 | A2 | 1/2008 |

OTHER PUBLICATIONS

ACE Boat Hoist, Piling Mounted Davits, web document accessed on Mar. 28, 2011, 5 pages, http://www.marinecosuppliers.com/20EP.pdf.

Photograph supplied by David Stein on Mar. 15, 2013 (actual date of photograph unknown) showing a Trailer-Mounted Boat Covering System allegedly constructed by Randy Kent prior to Nov. 24, 2009, 1 page.

* cited by examiner

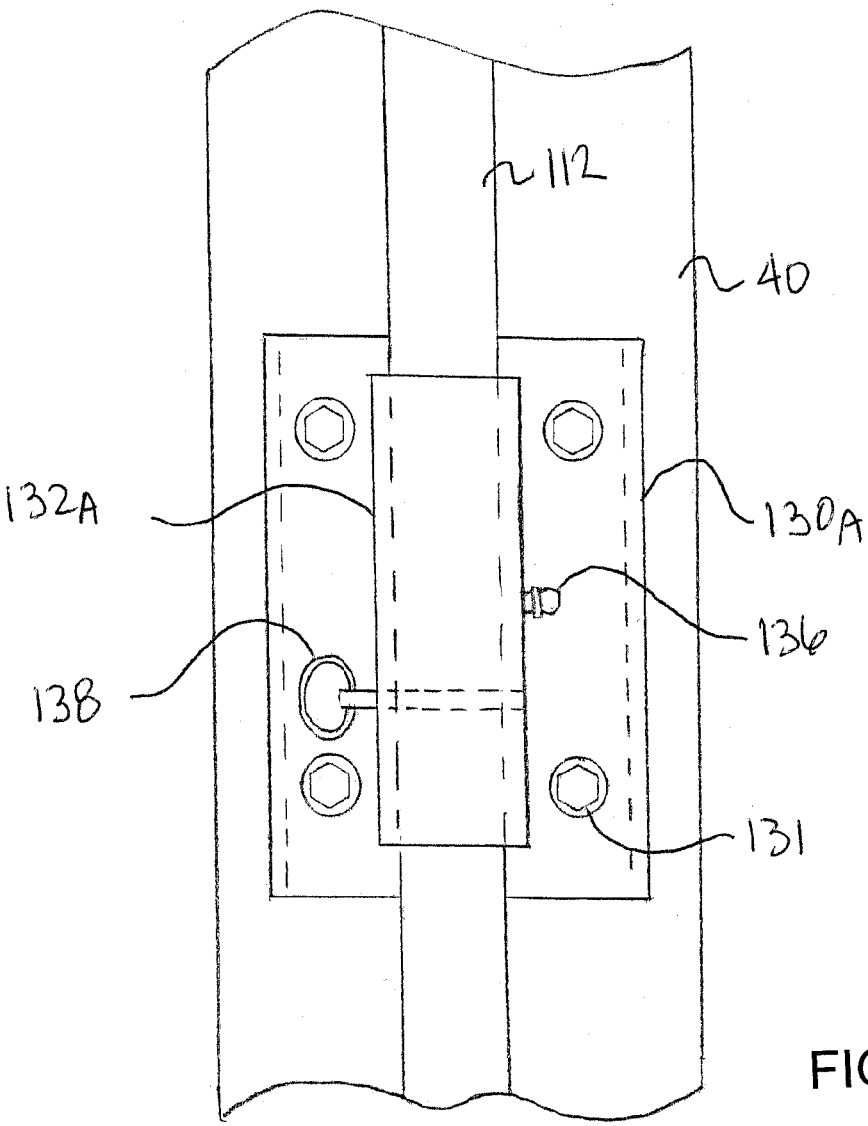
FIG. 10
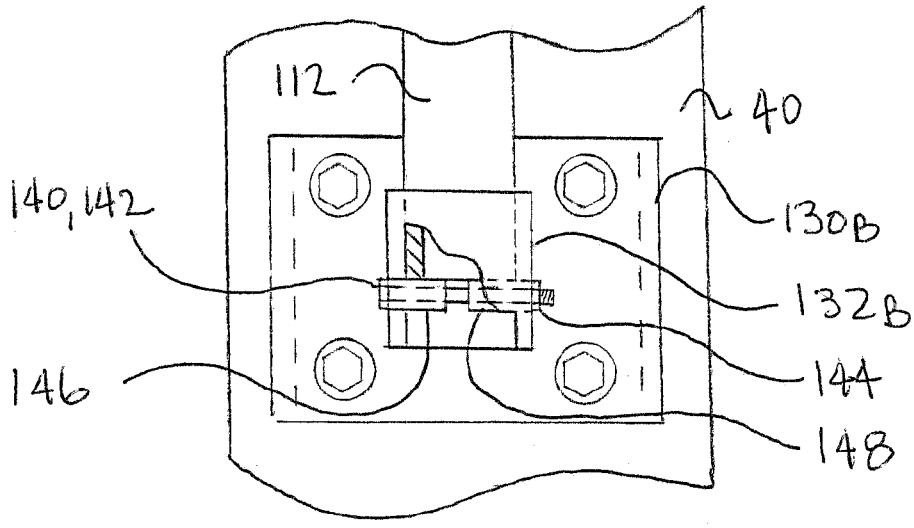

COVERING SYSTEM

This application claims priority to, and the benefit of, U.S. Provisional Patent Application No. 61/264,118, filed Nov. 24, 2009, which is herein incorporated by reference.

BACKGROUND OF THE INVENTION

1. Field of the Invention

The present invention relates to the administration of covers, and more particularly, to an erected structure facilitating retention, application, and removal of a cover to an object to be covered, such as a boat, a recreational vehicle, or a plane, for example.

2. Description of the Related Art

It may be desirous to cover any of a variety of objects. For example, covering systems may be used to cover boats. Boat covers are used in the boating industry for many reasons. Boat covers shield the boat from the environment such as rain, dirt and other debris, the sun, etc. Boat covers may also provide an aesthetic improvement to the boat itself.

There is a present need for an improved covering system, for example, a system that is movable and/or more efficiently facilitates the manipulation of a cover between an installed and uninstalled position about an object, such as a boat, for example, with which there is no preexisting overhead structure, such as, but not limited to, a roof.

SUMMARY OF THE INVENTION

The present invention relates to apparatus and methods for covering and uncovering a desired object. In a particular embodiment the invention includes a covering system comprising: a cover operably connected to a plurality of translational members translationally positioned along a track suspended above the cover; two or more hangers having a vertically extending portion and an outwardly extending portion, the track being operably attached to the outwardly extending portion, the track suspending below the outwardly extending portion of the hanger; and means for mounting hangers in a rotatable arrangement, the means mounting each of the two or more hangers to a structure, each hanger being rotatable about a vertical axis of rotation within the rotational mount.

A further embodiment of the present invention include a method for covering and uncovering a desired object, the steps including: mounting each of two or more hangers to a structure in a rotatable arrangement, the two or more hangers having a vertically extending portion and an outwardly extending portion, whereby the vertically extending portion is the portion of each hanger rotatably mounted to the structure; suspending a track from the outwardly extending portion of the two or more hangers; suspending a cover from the track, the cover being translatable along the track; and, rotating the two or more hangers between a covering position and a stored position, the covering position being arranged to position the track above an object to be covered, and the stored position being arranged to position the track to a side of the object to be covered.

The foregoing and other objects, features and advantages of the invention will be apparent from the following more detailed descriptions of particular embodiments of the invention, as illustrated in the accompanying drawing wherein like reference numbers represent like parts of the invention.

BRIEF DESCRIPTION OF THE DRAWINGS

FIG. 10 is a side elevation view of a bracket for mounting a hanger to a pylon, according to a particular embodiment of the present invention, wherein the bottom of the hanger is shown partially cutaway along an end portion to show the bearings upon which the hanger rests.

DETAILED DESCRIPTION OF THE INVENTION

The present invention generally concerns a temporary (i.e., removable) or permanent covering system comprising structure for covering a desired object. More specifically, the covering system includes structure comprising a track being suspended from rotatable hangers, the cover being translatable along the track between covering and uncovered arrangements. The hangers are also able to rotate between a covering position and a stored position. The structure may also be disassembled and stored in a disassembled position.

Figure 1:
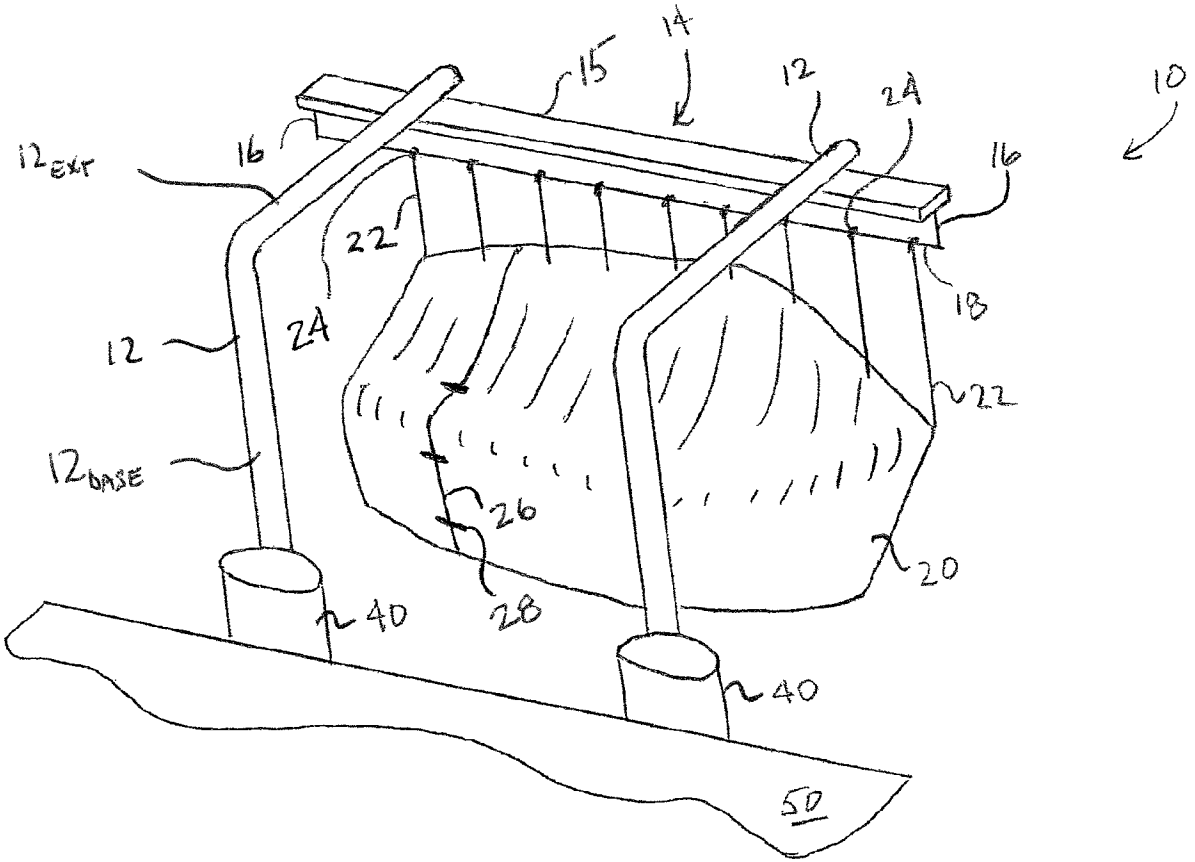
FIG. 1 is a perspective side view of a covering system, according to an embodiment of the invention.

Referring now to a first embodiment, FIG. 1 shows a perspective side view of a covering system according to particular embodiment of the invention. In such embodiment, cover system 10 is a boat cover system comprising at least one erected hanger structure (or hanger) 12, a track system 14 including cable support 15 and a cable 18, a boat cover 20, and cover suspension lines 22. Cable 18 forms a track for guided translation of the boat cover 20 in the present embodiment. In the system 10 shown, a pair of hangers 12 extend vertically (to form a vertical base $\mathbf{12}_{base}$) and then outwardly (to form an outward extension $\mathbf{12}_{ext}$) from the vertical base (and its vertical axis A) to create a structure from which a cable support 15 and/or cable 18 can be mounted for the administration of boat cover 20 positioned under the outward extension of hangers 12. With reference to FIGS. 2-6, hangers 12 are generally rotatable about a vertical axis A so to rotate the hanger's outward extension with the track system 14 and cover 20 relative to the boat and the area where the cover is administered (the covering and uncovering area). A vertical axis of rotation includes any axis generally extending in a vertical direction, meaning that a vertical axis of rotation may extend 90 degree relative a ground plane or at another angle less than 90 degrees so long as the axis of rotation is generally extending in a primarily vertical direction.

Figure 2:
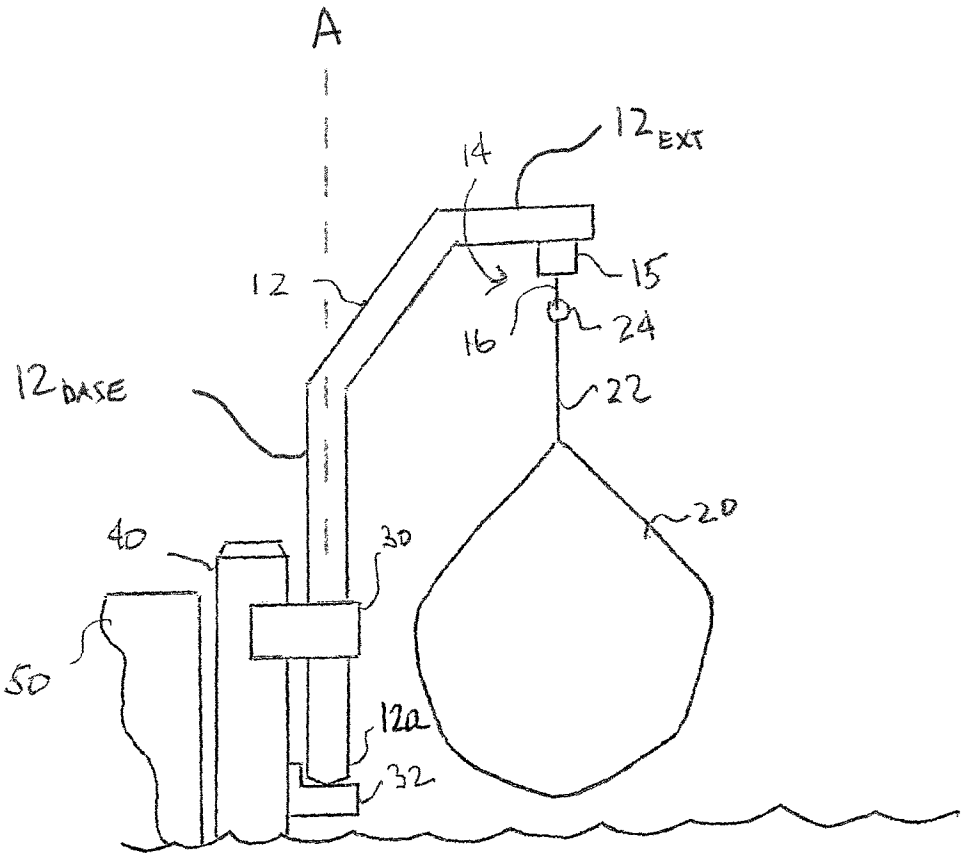
FIG. 2 is an end view of the a covering system, according to another embodiment of the invention, whereby the hangers of the covering system are mounted to structure positioned near or adjacent a body of water.

With reference to FIGS. 1-2, the hangers 12 are mounted to a structure 40, such as a pylon as shown, which may neighbor a dock 50, although it is understood that hangers 12 can be mounted to any other structure capable of receiving them. For example, hangers 12 may mount to any portion of a dock 50, a pillar, a beam, a rail, or any other independent structure extending above or below the water. This includes erecting a new structure for the specific purpose of supporting and attaching a hanger, which includes forming a structure underwater or a structure, such as a sleeve or bracket, within the ground. Hangers 12 may even be designed to attach to a boat lift, an aircraft hanger, or any other desired building or structure. It is understood that hangers may be adapted to attach to any surface of any structure, including any vertical or horizontal surface. As shown by example in the figures, each hanger is attached to a vertical surface of structure 40. When attaching to an existing structure, extensions, additions, or other modifications can be made to the existing structure to adapt and facilitate the attachment of any hanger to the existing structure. For example, a structural extension may be placed atop pylon 40 to provide a taller pylon to facilitate the mounting of a bracket 30 sufficiently spaced from lower bracket 32 for installation of hanger 12. Such an extension may be formed independent of, or as part of, bracket 30. Finally, hangers 12 may be made of steel, iron, aluminum, anodized aluminum pipe, or any other material known to a person of ordinary skill in the art, and may comprise any desired size, shape, form, or configuration.

In particular embodiments, hangers 12 are rotatably mounted to any such structure by a means for mounting in a rotatable arrangement, which may comprise any means known to one of ordinary skill in the art. For example, with reference to the embodiments shown in FIGS. 2-6, brackets 30, 32 are a means for mounting hangers 12 in a rotatable arrangement to structure 40. Bracket 30 may include a bearing means comprising any known means of facilitating improved rotation. For example, bearing means may comprise one or more bearings or bushings to facilitate rotation of hanger 12. Bearings may comprise any type of bearing, including ball or roller bearings. A bearing means may also comprise grease or other lubrication, which may be injected between the bracket and a hanger through a grease fitting. A grease fitting may also be used to facilitate the injection of grease or other lubrication into any bearing or bushing. A pin, bolt, screw, or the like, or any other means of preventing rotation may be used to secure hangers 12 in any desired rotational position.

The lower end 12*a* of hanger 12 may be free, such as where the brackets 30, 32 maintain hanger bottom 12*a* above any underlying structure or ground plane. In other embodiments, such as is shown by example in FIG. 2, hanger bottom end 12*a* contacts a lower bracket 32, which is referred to as a bottom end support member in this embodiment. In such variation, end 12*a* is configured to rotate relative to end support 32. To facilitate relative rotation, a bearing means, such as a roller, ball, bearing, or bushing, may be positioned between the end 12*a* and end support 32. End 12*a* and/or end support 32 may also be tapered or otherwise shaped to reduce contact area or rotation surface of the end 12*a*, which further facilitates relative rotation between the hanger 12 and the end support 32.

With continued reference to FIGS. 1 and 2, a track is suspended from hangers 12. Cover 20 operably engages the track, generally comprising cable 18, which is suspended from cable support 15. Cover 20 is adapted to travel along the longitudinal length of cable 18 as desired to facilitate the covering and uncovering of an underlying object. Cover 20 may be shaped to generally adapt to the outer shape of the object being covered, and may include an opening 26 for enclosing and unwrapping the cover 20 about the object. Opening closures 28, such as button, snaps, Velcro, ties, cordage, etc., may be used to maintain opening 26 in a closed position.

In the embodiment shown, suspending members 16 extend downwardly from support 15 to engage cable 18. Cable 18 is tensioned to allow smooth travel of cover 20. Cover suspension members or lines 22 attach to cover 20 at one end, and to cover translation members 24, which engage cable 18 in a manner to allow translation of members 24 along cable 18. Translation members 24 may comprise any known member suitable to achieve its purpose of relative translation, such as, for example, rings, sleeves, or rollers. Cover suspension members 22 may be made of rope, nylon, chain, cable, or any other material that may be known to a person of ordinary skill in the art. It can be said that cable 18 forms a track for the translation members 24 to travel. In other embodiments, in lieu of cable 18, a non-cable (i.e., structural or rigid) track may be used to translationally suspend cover 20. Translation members 24 would then travel along the non-cable track. The track may extend from cable support 15, or the support 15 may instead form the track. The track may comprise a C-channel or I-beam, for example, which translation members 24 operably engage to translate along, such as sliding or rolling, for example. An exemplary embodiment utilizing a non-cable track is shown in FIGS. 7-11, which is discussed more fully below.

Figure 3:
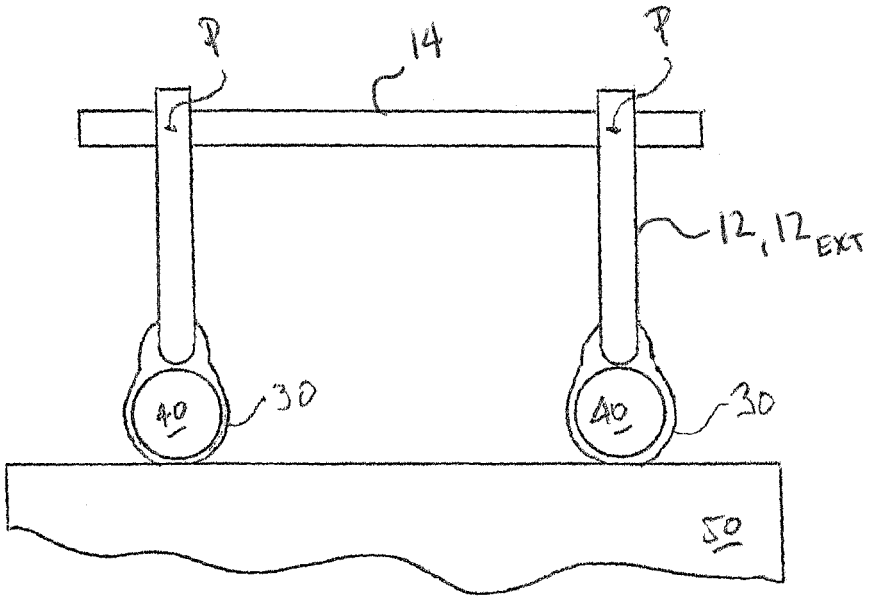
FIG. 3 is top view of an embodiment of the invention shown in a covering position.
Figure 4:
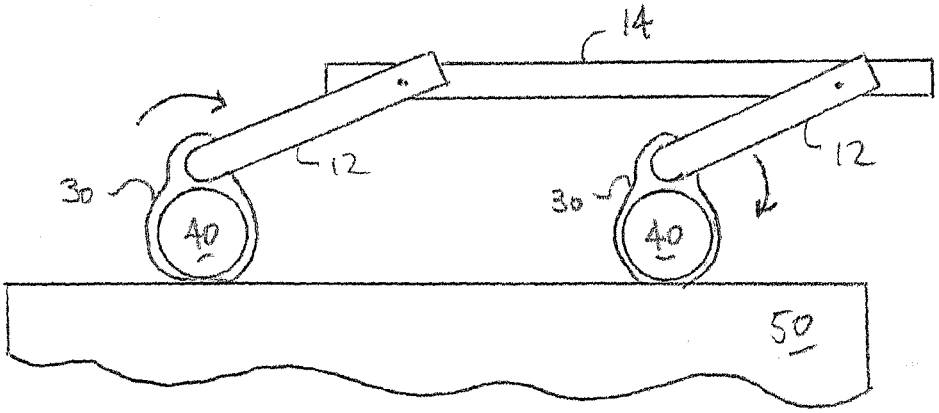
FIG. 4 is a top view of the embodiment shown in FIG. 3, after having been rotated to a non-covering or stored position.
Figure 5:
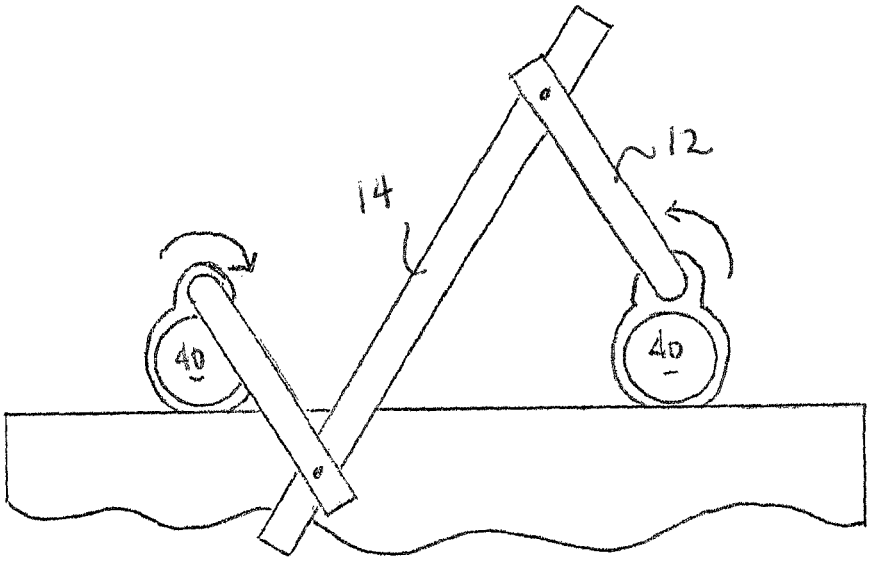
FIG. 5 is a top view of the embodiment shown in FIG. 3, shown in another non-covering or stored position.
Figure 6:
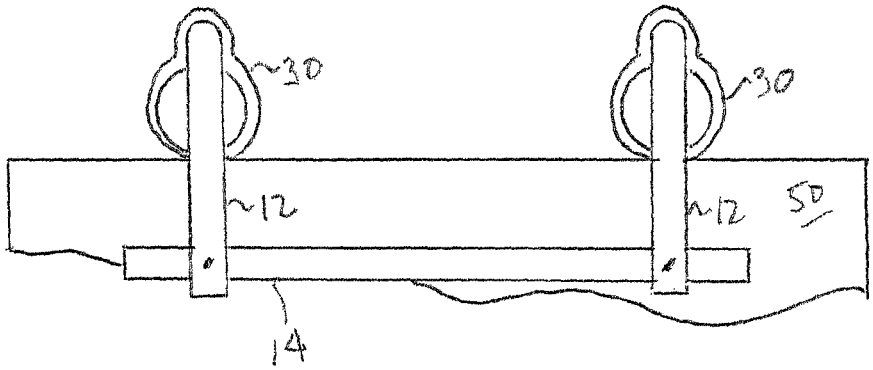
FIG. 6 is a top view of the embodiment shown in FIG. 3, shown in another non-covering or stored position.
Figure 7:
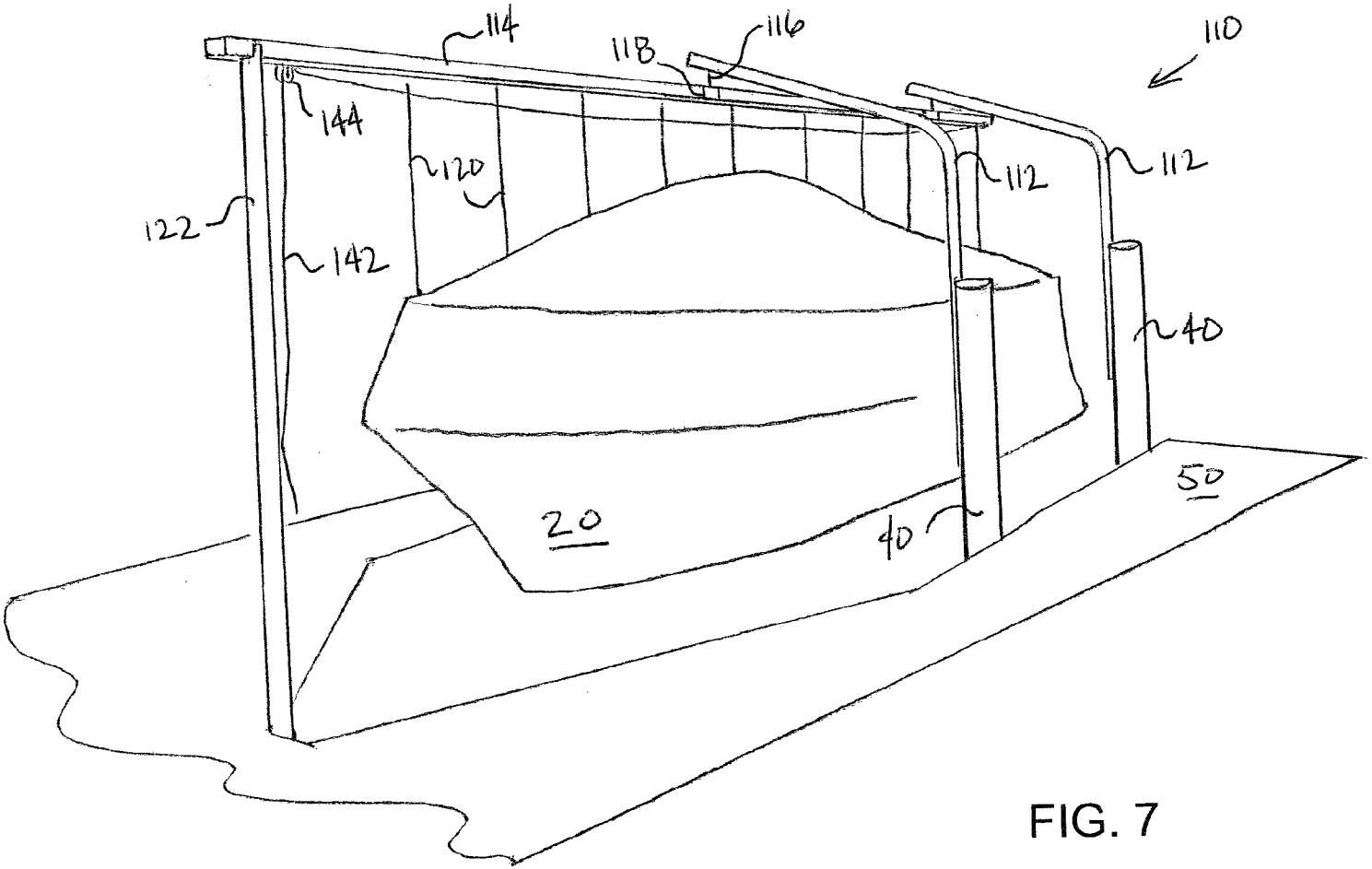
FIG. 7 is a perspective view of an additional exemplary embodiment of a cover system, the embodiment including a front support for the track.

FIGS. 3-6 show a top view of the boat cover system. In embodiments when hangers 12 are rotatable, it is now possible to rotate the track system 14 and hangers 12 away from the boat covering area, such as is shown in FIGS. 4 and 6. In FIG. 3, the boat cover system is shown in a boat cover covering or uncovering position, whereby the hangers are arranged to allow a boat cover to be translated between covered and uncovered positions. In FIG. 4, the hangers 12 each rotate in the same direction about corresponding pylons 40, while track system 14 translates with the rotating hangers 12. Hangers 12 rotate relative to track system 14 about mounting points P. Accordingly, track system 14 is mounted to hangers 12 by any means known to one of ordinary skill in the art to allow relative rotation there between. While hangers 12 and track system 14 may be sufficiently positioned away from the boat covering area in a stored position as generally shown in FIG. 4, whereby the cover remains on the same covering side of pylons 40, the hangers 12 and track 14 may be further positioned on the opposite side of the pylons 40 as shown by example in FIG. 6. To achieve this position, the hangers 12 are rotated as shown in FIG. 5 until both hangers have sufficiently moved track 14 to the other side of pylons 40. To return the boat cover system to its original, boat covering position, the previous steps are reversed.

With reference now to FIGS. 7-11, an additional embodiment of a cover system is shown. The cover system 110 is used to cover a boat, but may be used to cover other objects. In this embodiment, cover system 110 includes two hangers 112 extending from pylons 40 to which the pylons are rotatably attached. Suspended from the outward extension of each hanger 112 by way of suspension members 116 is a track 114. Track 114 includes a plurality of translation members 124 capable of translating along the track. A line 120 extends from each translation member 124 to operably connect each translation member 124 with the cover 20. Also included in this embodiment is a non-rotational (i.e., rotationally fixed) track support 122. Track support 122 provides additional support to track 114, such as when the track spans a longer object, such a boat arranged in an A-shaped dock as shown in this embodiment, although additional hangers 112 (i.e., more than two) could be employed for the same purpose. Track support 122 may be positioned anywhere along the length of the track. For example, with reference to FIG. 7, track support 122 may be arranged near any end of the track (which is referred to as a track end support). Track support 122 may include a releasable means for securing track 114. In the embodiment shown, a top end of support 122 is a U-shaped top end (i.e., notched) for receiving track 114. This way, an operator may simply raise and lower end support in of an installed position within cover assembly 110. Support 122 may form tubing or any other structure capable of supporting track 114, which may be formed from any known material such as steel, stainless steel, aluminum, or plastic. Support 122 may be installed onto any structure or surface as discussed above with reference to hanger 12, and according to any known mounting means, such as a using one or more brackets, including any structure or mounting means contemplated for any hanger 112, and may extend in any vertical direction to track 114.

Cover assembly may also include a means for translating the cover between covered and uncovered arrangements. In the embodiment shown in FIG. 7, the means for translating the cover comprises a cover transmission line 142 in operable communication with a pulley 144 to pull the cover from a covered arrangement to an uncover arrangement. As shown, one end of the transmission line 142 is located in a convenient location at a first end of the cover assembly 110 for access by an operator, while the other end of the line 142 is operably attached to a translation member 124 or the cover line 120 located at an opposite end of the cover assembly 110. Of course, one or more additional pulleys may be employed to redirect the line as necessary to allow the operator to access the operator end of the line 142 at any desired location along the cover assembly, including the end of the cover assembly where the transmission line 142 is attached to one of the translation member 124 or the cover line 120. It is contemplated that any other means for translating the cover between covered and uncovered arrangements known to one of ordinary skill may be employed as desired.

Figure 8:
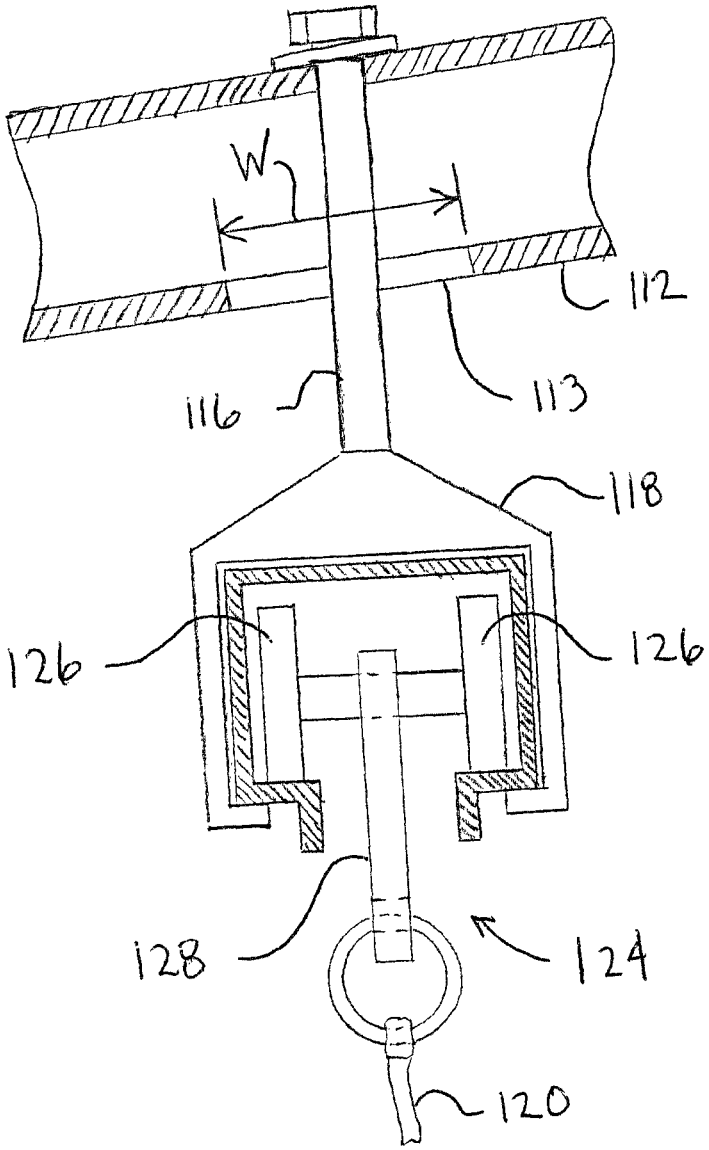
FIG. 8 is a sectional view of a hanger of FIG. 7 showing a suspension member with a track and translation member.
Figure 9:
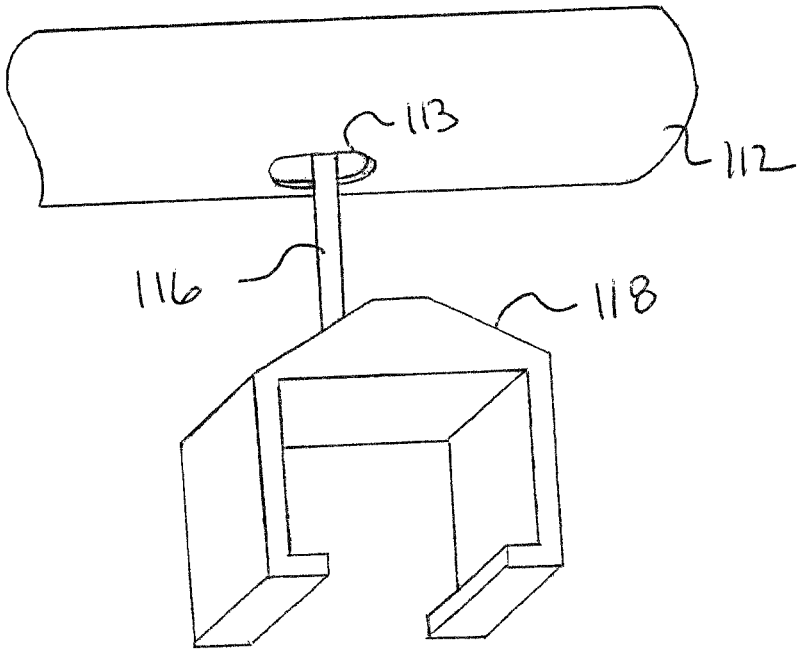
FIG. 9 is a upward perspective view of a hanger of FIG. 8.

With reference to FIGS. 8 and 9, a more detailed view of the hanger 112 and track 114 is shown according to a particular embodiment. As shown, suspension member 116 extends downwardly from a top of the outwardly extending portion of hanger 112 from a first aperture and through a bottom of the hanger 112 through a second aperture 113. A flexible washer or sealing member may be positioned between the suspension member 116 and the first aperture to assist in sealing the aperture and to allow the suspension member 116 to pivot as necessary to self-level the track 114. To facilitate self-leveling capabilities, the second aperture 113 has an opening having a width W, which is sufficiently larger than the local thickness of the suspension member 116 to allow the suspension member 116 to pivot about the first aperture and thereby self-level the track 114 relative to the ground if the hanger is not perfectly aligned. This provides a suspension member that is pivotable relative to the corresponding hanger, and a track that is also pivotable relative to a corresponding hanger. Second aperture 113 may form any shaped aperture of sufficient size. For example, second aperture 113 may form an oversized circle or an elongated aperture.

With continued reference to FIGS. 8 and 9, suspension member 116 includes a track holder 118. Suspension member 116 and track holder 118 may be formed by any known means. For example, suspension member 116 and track holder 118 may be formed monolithically, such as by molding or extrusion, or formed separately and attached by any known means, such as by threaded attachment or welding. Each may be formed of any material sufficient to withstand the loads for the particular application. For example, each may be formed by aluminum, steel, or stainless steel.

Track holder 118 may comprise any member capable of suspending track in any desired arrangement. For example, in the embodiment of FIG. 8, track holder forms a C-channel having flanges extending inwardly along an open bottom side to retain track 114 therein. Track holder 118 may form any other shape. It is also understood that in lieu of using a track holder 118, suspension member 116 may be operably attached directly to track 114 by any known means, such as by fastener or weld, for example.

Track 114 may comprise any known form that is capable of allowing a translation member 124 of any known form to translate longitudinally along track 114. For example, in the embodiment of FIG. 8, track 114 forms a C-channel having flanges extending inward along its open bottom side. Within track 114, translation member 124 is arranged to translate longitudinally along the track 114. Translation member 124 may take any form capable of translating along track 114. In the embodiment shown, translation member 124 includes a pair of wheels 126. Extending from translation member 124 is cover line 120, which may attach to any portion of translation member 124, including an extension 128.

As mentioned above, hangers may be attached to any support structure by any known means. With reference to the embodiment of FIGS. 10 and 11, hangers 112 are affixed to pylon 40 using one or more brackets. In the specific embodiment, top and bottom brackets 130A, 130B each forming a C-channel are employed. The C-channel allows the bracket to better adapt to a pylon having a rounded cross-section as shown by example in FIG. 11. It is understood that the shape of any bracket may be selected and altered as desired to better adapt to the structure to which the bracket will be mounted. Shims (not shown) may be used to adjust the mounting of bracket 130 to any structure as necessary to properly align hangers 112. Any known means of affixing any bracket to a structure may be employed, such as fasteners 131, for example.

Figure 11:
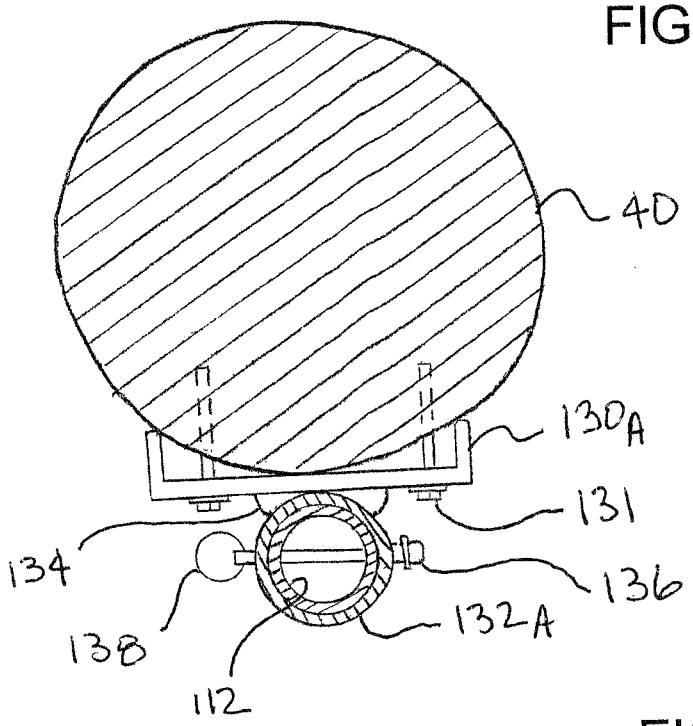
FIG. 11 is a cross-sectional view of a bracket and pylon of FIG. 10.

To facilitate rotation of each hanger, brackets include hanger rotation members. In the embodiments of FIGS. 10 and 11, hanger rotation members 132A and 132B form tubes each having an inside diameter greater than the outer diameter of any hanger 112. Any known rotational bearing means may be arranged between any rotation member 132A, 132B and a corresponding hanger 112. The bearing means may comprise one or more bearings, or a bearing lubricant, such as grease or the like. In the embodiment shown, grease fittings 136 are employed to facilitate injection of a lubricating bearing means between the hanger 112 and rotation member 132A, 132B. Each rotation member 132A, 132B may be formed with bracket 130A, 130B, such as through extrusion or molding, or may be attached to bracket 130A, 130B by any known means, such as by welds 134. A pin 138 or other known member may be used to fix the rotational position of each hanger.

To constrain the vertical position of each hanger, a vertical constraint is employed. With reference to FIG. 10, bottom rotation member 132B includes a stop 140 that may include a bearing means. Any known stop or bearing means may be employed as desired. For example, in the embodiment shown, stop 140 includes a rod comprising a shoulder bolt 142 having a smooth outer diameter secured by a nut 144. Shoulder bolt 142 may include one or more bearings or bushings upon which hanger 112 rotates. In the embodiment shown, a pair of bearings 146, 148 are provided to allow hanger 12 to rotate along the shoulder bolt 142. The pair of bearings are rotatable in opposing directions arranged along its length of the rod in series. By having a pair of bearings, each bearing 146, 148 is able to rotate in opposite directions as hanger 112 rotates about axis A. In operation, hangers 112 of covering system 110 may rotate as discussed in association with the embodiment of FIGS. 4-6.

The cover systems described above are only exemplary embodiments used to describe the generally invention. Accordingly, such systems may be used in addition to other embodiments of the cover assembly to practice methods of covering and uncovering a desired object. Particular methods may include mounting each of two or more hangers to a structure in a rotatable arrangement, the two or more hangers having a vertically extending portion and an outwardly extending portion, whereby the vertically extending portion is the portion of each hanger rotatably mounted to the structure; suspending a track from the outwardly extending portion of the two or more hangers; suspending a cover from the track, the cover being translatable along the track; and, rotating the two or more hangers between a covering position and a stored position, the covering position being arranged to position the track above an object to be covered, and the stored position being arranged to position the track to a side of the object to be covered. As discussed above with reference to FIGS. 3-6, the hangers may rotate the same direction between the covering and stored positions, or any other direction or manner as discussed in association with any system 10, 110 above. The step of mounting may further include mounting a track end support along a structure to extend vertically and engage a portion of the track, wherein the track end support is removed before performing the step of rotating the two or more hangers.

While this invention has been described with reference to particular embodiments thereof, it shall be understood that such description is by way of illustration and not by way of limitation. Accordingly, the scope and content of the invention are to be defined only by the terms of the appended claims.

We claim:

1. A covering system comprising:

a cover operably connected to a plurality of translational members translationally positioned along a track suspended above the cover;

two or more hangers having a vertically extending portion and an outwardly extending portion, the track being operably attached to the outwardly extending portion, the track suspending below the outwardly extending portion of the hanger;

means for mounting said hangers in a rotatable arrangement, the means mounting each of the two or more hangers to a structure, each hanger being rotatable about a vertical axis of rotation within a rotational mount; and, one or more suspension members each extending between the outwardly extending portion of one of the two or more hangers and the track such that the one or more suspension members are configured to pivotally suspend the track from the two or more hangers, where each of the one or more suspension members are configured to pivot such that the track is configured to pivot relative the hanger.

2. The system of claim 1, wherein each said suspension member extends though a first aperture and a second aperture, the second aperture being substantially larger than the local cross-section of the suspension member whereby the suspension member is pivotable relative to the corresponding hanger, and whereby the track is pivotable relative to a corresponding hanger.

3. The system of claim 1, wherein the means for mounting hangers in a rotatable arrangement comprises one or more mounting brackets including one or more rotational mounts into which the vertically extending portion of one of the two or more hangers is received, such hanger being rotatable about a vertical axis of rotation within the one or more rotational mounts.

4. The system of claim 3, wherein the one or more rotational mounts of each mounting bracket include a bearing means to facilitate rotation of each hanger.

5. The system of claim 4, wherein the bearing means is a lubrication fitting in operable communication with an internal cavity of the rotational mount.

6. The system of claim 3, wherein the mounting bracket is a longitudinally extending C-channel from which the rotational mount extends, the rotational mount having a rotational axis extending in a longitudinal direction of the mounting bracket.

7. The system of claim 3, wherein the mounting bracket includes a stop for maintaining the vertical arrangement of each hanger.

8. The system of claim 7, wherein the mounting bracket includes a bearing means associated with the stop to facilitate rotation of each hanger.

9. The system of claim 8, wherein the stop is a rod having a pair of bearings rotatable in opposing directions arranged along the length of the rod in series.

10. The system of claim 1, wherein a line extends between the cover and each of the plurality of translational members to suspend the cover from the track.

11. The system of claim 1 further comprises:

one or more transmission lines operably attached to the plurality of translational members of the track, the transmission lines being in operable communication with one or more pulleys to facilitate movement of the cover.

12. The system of claim 1, wherein each suspension member includes a track support along which the track is suspended.

13. The system of claim 1, wherein the track forms a channel having an open bottom side, the plurality of translational members being positioned within the channel and the cover being in communication with the translational members through the open bottom side.

14. The system of claim 1, wherein the track forms a cable and the translational members form a plurality of rings arranged along the cable.

15. The system of claim 1 further comprising a rotatably fixed track support extending between a structure to which it is mounted and the track.

16. A method for covering an object, the method comprising the steps of:

mounting each of two or more hangers to a structure in a rotatable arrangement, the two or more hangers having a vertically extending portion and an outwardly extending portion, whereby the vertically extending portion is the portion of each hanger rotatably mounted to the structure;

suspending a track from the outwardly extending portion of the two or more hangers using one or more suspension members such that the track is configured to pivot relative the hanger by way of the one or more suspension members;

suspending a cover from the track, the cover being translatable along the track; and, rotating the two or more hangers between a covering position and a stored position, the covering position being arranged to position the track above an object to be covered, and the stored position being arranged to position the track to a side of the object to be covered.

17. The method of claim 16, wherein the hangers rotate the same direction between the covering and stored positions.

18. The method of claim 16, wherein the two or more hangers are attached to a structure positioned adjacent a body of water and the cover is a boat cover.

19. The method of claim 16, wherein the step of mounting includes mounting a rotationally fixed track support along a structure to extend vertically and engage a portion of the track, wherein the track support is removed before performing the step of rotating the two or more hangers.

20. The method of claim 19, wherein the rotationally fixed track support is arranged near an end of the track.

* * * * *

UNITED STATES PATENT AND TRADEMARK OFFICE

CERTIFICATE OF CORRECTION

PATENT NO. : 8,783,276 B2
APPLICATION NO. : 12/954559
DATED : July 22, 2014
INVENTOR(S) : Edward J. Skrzynski et al.

It is certified that error appears in the above-identified patent and that said Letters Patent is hereby corrected as shown below:

IN THE CLAIMS:

Column 9, line 13, Claim 21 should be included.

21. A covering system comprising:

a cover operably connected to a plurality of translational members translationally positioned along a track suspended above the cover;

two or more hangers having a vertically extending portion and an outwardly extending portion, the track being operably attached to the outwardly extending portion, the track suspending below the outwardly extending portion of the hanger;

means for mounting said hangers in a rotatable arrangement, the means mounting each of the two or more hangers to a structure, each hanger being rotatable about a vertical axis of rotation within a rotational mount;

wherein the means for mounting hangers in a rotatable arrangement comprises one or more mounting brackets including one or more rotational mounts into which the vertically extending portion of one of the two or more hangers is received, such hanger being rotatable about a vertical axis of rotation within the one or more rotational mounts;

wherein the mounting bracket includes a stop for maintaining the vertical arrangement of each hanger;

wherein the mounting bracket includes a bearing means associated with the stop to facilitate rotation of each hanger; and, wherein the stop is a rod having a pair of bearings rotatable in opposing directions arranged along the length of the rod in series.

Signed and Sealed this
Eighteenth Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,783,276 B2
APPLICATION NO. : 12/954559
DATED : July 22, 2014
INVENTOR(S) : Edward J. Skrzynski et al.

It is certified that error appears in the above-identified patent and that said Letters Patent is hereby corrected as shown below:

On the title page, under abstract "20 Claims, 8 Drawing Sheets" should read --21 Claims, 8 Drawing Sheets--.

IN THE CLAIMS:

Column 9, line 13, Claim 21 should be included.

21. A covering system comprising:

a cover operably connected to a plurality of translational members translationally positioned along a track suspended above the cover;

two or more hangers having a vertically extending portion and an outwardly extending portion, the track being operably attached to the outwardly extending portion, the track suspending below the outwardly extending portion of the hanger;

means for mounting said hangers in a rotatable arrangement, the means mounting each of the two or more hangers to a structure, each hanger being rotatable about a vertical axis of rotation within a rotational mount;

wherein the means for mounting hangers in a rotatable arrangement comprises one or more mounting brackets including one or more rotational mounts into which the vertically extending portion of one of the two or more hangers is received, such hanger being rotatable about a vertical axis of rotation within the one or more rotational mounts;

wherein the mounting bracket includes a stop for maintaining the vertical arrangement of each hanger;

wherein the mounting bracket includes a bearing means associated with the stop to facilitate rotation of each hanger; and, wherein the stop is a rod having a pair of bearings rotatable in opposing directions arranged along the length of the rod in series.

This certificate supersedes the Certificate of Correction issued November 18, 2014.

Signed and Sealed this
Sixteenth Day of December, 2014

Michelle K. Lee

Michelle K. Lee
*Deputy Director of the United States Patent and Trademark Office*